US008854289B2

(12) United States Patent
Yin

(10) Patent No.: US 8,854,289 B2
(45) Date of Patent: Oct. 7, 2014

(54) INTRA-SYSTEM INTERFACE UNIT OF FLAT PANEL DISPLAY

(75) Inventor: Xinshe Yin, Beijing (CN)

(73) Assignee: Beijing BOE Optoelectronics Technology Co., Ltd., Beijing (CN)

( * ) Notice: Subject to any disclaimer, the term of this patent is extended or adjusted under 35 U.S.C. 154(b) by 1110 days.

(21) Appl. No.: 11/934,827

(22) Filed: Nov. 5, 2007

(65) Prior Publication Data

US 2008/0106510 A1 May 8, 2008

(30) Foreign Application Priority Data

Nov. 3, 2006 (CN) ..... 2006 1 0138046

(51) Int. Cl.
*G09G 3/36* (2006.01)
*G09G 3/20* (2006.01)

(52) U.S. Cl.
CPC ..... *G09G 3/20* (2013.01); *G09G 2370/08* (2013.01); *G09G 2330/06* (2013.01); *G09G 2310/027* (2013.01); *G09G 2340/02* (2013.01)
USPC ..... 345/98; 345/204

(58) Field of Classification Search
CPC ..... G09G 3/20
USPC ..... 345/98, 204
See application file for complete search history.

(56) References Cited

U.S. PATENT DOCUMENTS 4,150,400 A * 4/1979 Wong ..... 382/299
5,659,631 A * 8/1997 Gormish et al. ..... 382/166
6,038,346 A * 3/2000 Ratnakar ..... 382/239
6,055,064 A * 4/2000 Lifshitz et al. ..... 358/1.9
6,522,783 B1 * 2/2003 Zeng et al. ..... 382/239
6,563,505 B1 * 5/2003 Mills et al. ..... 345/522
7,450,115 B2 11/2008 Kang
7,683,873 B2 * 3/2010 Okamura et al. ..... 345/98
2002/0070912 A1 * 6/2002 Asuma et al. ..... 345/92
2003/0142055 A1 * 7/2003 Iisaka ..... 345/89
2004/0155855 A1 * 8/2004 Chang ..... 345/102
2005/0140619 A1 * 6/2005 Hong ..... 345/87

(Continued)

FOREIGN PATENT DOCUMENTS

CN 1619481 A 5/2005
CN 1798045 A 7/2006

OTHER PUBLICATIONS

U.S. Appl. No. 12/104,575, filed Apr. 17, 2008, Xinxin Li.

*Primary Examiner* — Kwang-Su Yang
(74) *Attorney, Agent, or Firm* — Hasse & Nesbitt LLC; Daniel F. Nesbitt

(57) ABSTRACT

The present invention discloses an intra-system interface unit in a flat panel display comprising: a control IC unit and a driving IC unit. The control IC unit receives an external image data signal and compresses and processes the image signal data. The control IC unit sends the resulting signal to the driving IC unit through an interface therein. The data is decompressed within the driving IC unit and then output. The control IC unit comprises a signal receiver, a gray level data classifier, a data and address encoder, and a differential signal sender. The driving IC unit comprises a differential signal receiver, a data and address separator, a gray level data processor, an address decoder, a channel addresser, and an output circuit. The present invention lowers the repeated transfer of the same gray data in a row, thereby lowering the interface clock frequency, which facilitates transferring data with higher resolution and lowering the electromagnetic interference of the system.

4 Claims, 2 Drawing Sheets

(56) References Cited

U.S. PATENT DOCUMENTS

| | | | | |
|---|---|---|---|---|
| 2005/0253824 | A1* | 11/2005 | Lin | 345/204 |
| 2006/0087521 | A1* | 4/2006 | Chu et al. | 345/690 |
| 2006/0150235 | A1 | 7/2006 | Hsieh et al. | |
| 2006/0262065 | A1* | 11/2006 | Luo et al. | 345/98 |
| 2007/0229434 | A1* | 10/2007 | Liao | 345/98 |
| 2007/0246707 | A1 | 10/2007 | Deng | |
| 2007/0272926 | A1 | 11/2007 | Deng | |
| 2007/0298554 | A1 | 12/2007 | Long | |
| 2008/0030639 | A1 | 2/2008 | Qiu | |
| 2008/0100766 | A1 | 5/2008 | Ming | |
| 2008/0105873 | A1 | 5/2008 | Wang | |
| 2008/0105874 | A1 | 5/2008 | Wang | |
| 2008/0111136 | A1 | 5/2008 | Qiu | |
| 2008/0111934 | A1 | 5/2008 | Wu | |
| 2008/0117347 | A1 | 5/2008 | Zhang | |
| 2008/0123007 | A1 | 5/2008 | Cui | |
| 2008/0123030 | A1 | 5/2008 | Song | |
| 2008/0142802 | A1 | 6/2008 | Qiu | |
| 2008/0142819 | A1 | 6/2008 | Liu | |
| 2008/0164470 | A1 | 7/2008 | Wang | |
| 2008/0166838 | A1 | 7/2008 | Long | |

* cited by examiner

INTRA-SYSTEM INTERFACE UNIT OF FLAT PANEL DISPLAY

FIELD OF THE INVENTION

The present invention mainly relates to a flat panel display and, particularly, to an intra-system interface unit between a control IC and a driving IC of the flat panel display.

BACKGROUND OF THE INVENTION

Currently, transistor-transistor logic signal (TTL), mini-LVDS and RSDS interfaces are mostly used as interfaces between a control IC and a driving IC of a flat panel display. These three traditional interfaces are characterized in that all the driving ICs use a common data bus, and a row of data is transferred to the driving ICs in the order of one pixel point by one pixel point. Since the data received by the control IC is sent in the order of one pixel point by one pixel point, the control IC first transfers the data of the first driving IC, and then the data of the second driving IC, in turn. Thus, the occupying in the bus by the driving IC is split by time, as shown in FIG. 1.

In the figure, there are n pixel points 201 in a panel, and each pixel point has sub-pixels 202 of three colors, red, green and blue (R in FIG. 1 refers to red, G refers to green, and B refers to blue). There are 3*n gray data in this row. In actual practice, data of RGB of the first pixel are transferred in the first pixel clock, and data of RGB of the second pixel are transferred in the second pixel clock, and in turn, data of RGB of the nth pixel are transferred in the nth pixel clock. It is known that there are only 64 gray levels in a 6-bit monitor, thus during data transfer of this row, many gray data are transferred repeatedly. That is to say, efficiency of data transfer is relatively low. Reference number 203 is a clock signal for transferring data between the control IC and the driving IC. Reference number 204 is a data sequence for transferring data between the control IC and the driving IC.

In order to improve transferring rate and quality, there appeared some techniques recently, such as point-to-point differential signal (PPDS) proposed by National Semiconductor in US, and Wisebus and current-control-mode differential signal (CMADS) proposed by Samsung in Korea. Although these interface techniques separate the transfer data buses, the transfer of corresponding pixel points within a driving IC is also performed in the order of one pixel point by one pixel point. If the same gray data are transferred in a driving IC, a phenomenon of image data being repeatedly transferred will still occur.

SUMMARY OF THE INVENTION

With respect to the defects in the prior art, the present invention provides an interface system unit in a flat panel display with improved transferring efficiency and lowered transfer clock frequency.

To achieve the above objects, the present invention provides an intra-system interface unit in a flat panel display comprising a control IC unit and a driving IC unit. The control IC unit receives an image signal data output externally and compresses and processes the image signal data. The control IC sends the image signal data to the driving IC unit through an interface therebetween. The data is decompressed within the driving IC unit and then output.

The control IC unit comprises: a signal receiver that receives the image signal data output externally, and decodes the image signal data to resolve it into a logic signal that can be processed within the control IC; a gray level data classifier that receives the data sent by the signal receiver, classifies the data in accordance with gray level data, and groups addresses of sub-pixel points of the data with the same gray level in a row; a data and address encoder that receives the data sent by the gray level data classifier, firstly address-encodes the sub-pixel points of the display screen such that each sub-pixel point has a unique address code, and then combines the classified data and addresses together to mixed-encode them to form a new information code which contains an image data and its corresponding sub-pixel address code; and a differential signal sender that receives the information code sent from the data and address encoder, and converts the information code to a differential signal according to a certain rule to send the code to the driving IC unit.

In the above unit, when the gray level data classifier classifies the addresses of the sub-pixel points which are displayed in the display screen in correspondence with each image gray level data in a row, an address may be prescribed as 0 if there is no display for a certain image gray level data in a certain row. When the data and address encoder performs mixed-encoding, if there is no display for a certain image gray level data in a certain row, it is prescribed that the data code of the encoded information code is a gray level data, and the address information is 0

The driving IC unit comprises a differential signal receiver that receives a differential signal sent from the control IC unit, decodes the differential signal, and converts the decoded signal into a transistor-transistor logic signal that can be processed by the driving IC unit, the data also containing the image gray level data and its corresponding address information of all sub-pixels. The driving IC unit also includes a data and address separator that receives the transistor-transistor logic signal sent from the differential signal receiver, and separates the signal into the image gray level data and the address information of the sub-pixel in the panel corresponding to the image data. A gray level data processor receives the image gray level data separated by the data and address separator and processes the data. An address decoder receives the address information separated by the data and address separator and decodes it, deciding if the driving IC has the address of the sub-pixel output corresponding to these addresses, and writes the corresponding gray level data into a register corresponding to an output port if the result of the decision is confirmative; and if the output port corresponding to the driving IC does not have the address corresponding to the gray level, the driving IC discards the gray level data. A channel addresser that receives the signals sent from the gray level data processor and the address decoding circuit compares the address decoded by the address decoding circuit to the port address output from the driving IC, and sends the gray level data to the registers corresponding to the output ports until each gray level in the whole row finds its corresponding output port. If one or more port addresses are consistent with the decoded address; then an output circuit that receives the signal sent from the channel addressing circuit, converts the data in the register corresponding to each port into a corresponding analog voltage through digital-analog conversion, and outputs the analog voltage to the corresponding sub-pixel points on the panel after amplification.

The present invention puts together the pixel points with the same gray data while address-encoding the corresponding points. The control IC sends to the driving IC the address codes at first, then sends the data information, thus the driving IC may find the corresponding pixel point according to the address information and then send the gray data to the corresponding pixel point. Therefore, one gray level data only needs to be transferred once. That is to say, by encoding the data and address, the repeated data in a row is compressed. The transfer efficiency is thus improved, and the transfer clock frequency is lowered, which makes it possible for the system to transfer data with a higher resolution.

The present invention will be further described in detail in connection with the attached figures and specific embodiments below.

DETAILED DESCRIPTION OF THE INVENTION

Figure 1:
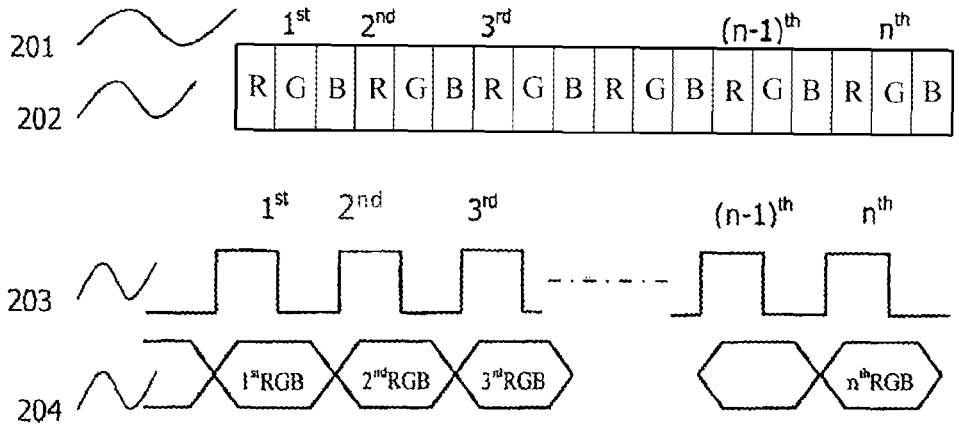
FIG. 1 is an interface data transfer manner in the prior art.
Figure 2:
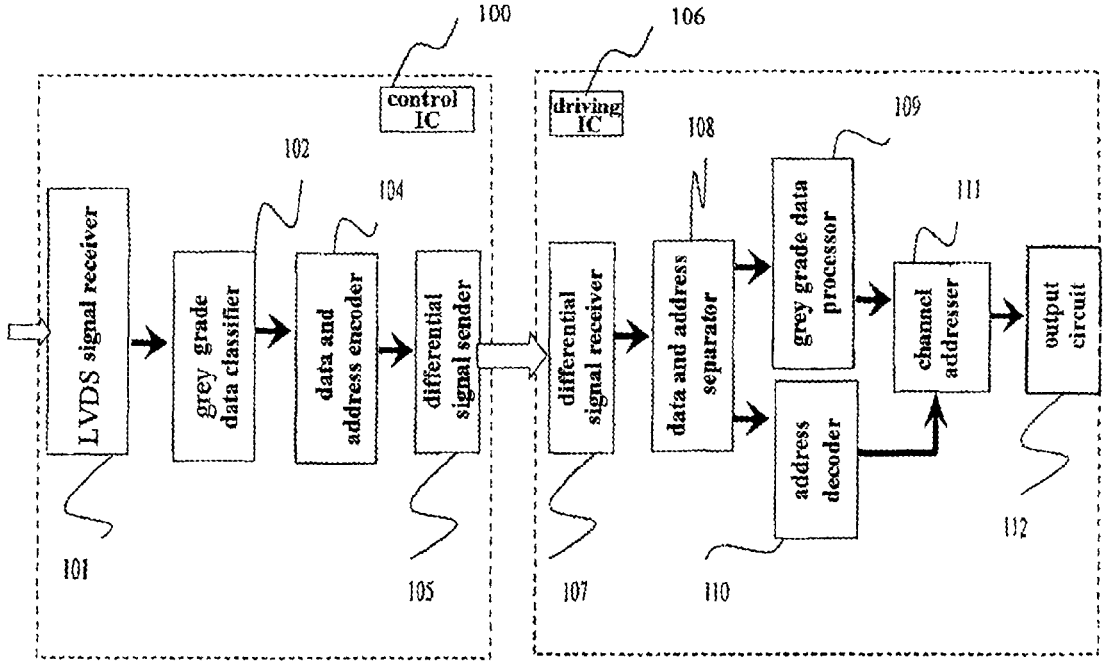
FIG. 2 is an interface system unit of the present invention.

FIG. 2 represents a block diagram of an interface system unit in a flat panel display according to the present invention. As shown in FIG. 2, the interface system unit of the invention mainly consists of a control IC 100 and a driving IC 106. The control IC 100 comprises an LVDS signal receiver 101, a gray level data classifier 102, a data and address encoder 104, and a differential signal sender 105. The driving IC 106 comprises a received-data separator 108, a gray level data processor 109, an address decoder 110, a channel addresser 111, and an output circuit 112. The control IC 100 of the present invention firstly mixed-encodes an image data to be sent and the addresses of corresponding pixel points to which the data will be sent, and encodes the pixel points with the same gray level together. The corresponding driving IC 106 receives the codes at the same time, which are decoded within the driving IC 106, and sends the corresponding data to specified displaying pixel points. The present invention lowers repeated transfer of the same gray data in a row, thereby lowering the interface clock frequency, which facilitates transferring data with higher resolution and lowering the electromagnetic interference of the system.

The block diagram in FIG. 2 is described in detail below in conjunction with the effects of the respective functional modules.

The control IC includes a means for receiving image data from an external source. An example of a means for receiving image data is a low-voltage differential signal (LVDS) receiver 101. The LVDS receiver 101 receives a differential signal of the externally output image signal. The LVDS signal receiver 101 converts the differential signal into a transistor-transistor logic (TTL) image data signal, an enable synchronization signal, a row synchronization signal, and a field synchronization signal. An exemplary LVDS receiver is manufactured by National Semiconductor and is described in further detail in the National Semiconductor LVDS Owner's Manual, $2^{nd}$ Edition, entitled *Moving Info with LVDS–A General Design Guide for National's Low Voltage Differential Signaling (LVDS) and Bus LVDS Products*, which is hereby incorporated herein in its entirety by reference.

The gray level data classifying functional block 102 classifies the image data received by the LVDS signal receiver 101 and the image data signal in the synchronization signal or the row synchronization signal or the field synchronization signal in accordance with the gray levels, that is, the gray level data classifying circuitry combines the addresses of pixel points corresponding to the same gray level.

At first, each sub-pixel point (each red sub-pixel point, green sub-pixel point and blue sub-pixel point consists of a color sub-pixel point) on the display screen is address-encoded so that each sub-pixel point may be identified easily. For example, for a display screen with resolution of n*m, i.e. a display screen with m rows each having n pixel points, there are 3n sub-pixel points total in a row. The 3n sub-pixel points are numbered as 1, 2, 3, . . . 3n, and these numbers function as the addresses of the corresponding sub-pixel points, thus each sub-pixel point has a unique address corresponding thereto.

Figure 3:
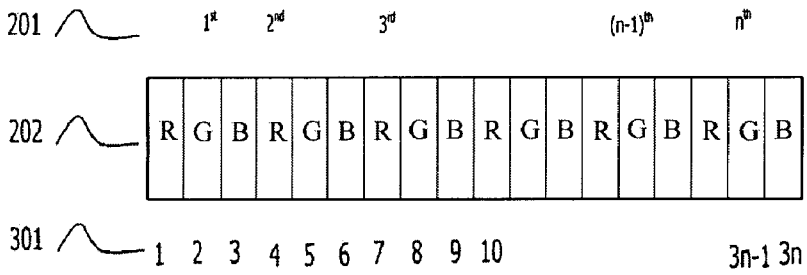
FIG. 3 is sub-pixel number and address coding of the present invention.

In FIG. 3, the addresses of the sub-pixel points 202 of n pixel points 201 in one row of a display are encoded as shown by reference numeral 301, where R represents red, G represents green and B represents blue. The address of the red sub-pixel of the first pixel is 1, the address of the green sub-pixel of the first pixel is 2, and the address of the blue sub-pixel of the first pixel is 3, . . . the address of the red sub-pixel of the nth pixel is 3n−2, the address of the green sub-pixel of the nth pixel is 3n−1, and the address of the blue sub-pixel of the nth pixel is 3n.

Next, 3n gray data of the pixel points in a row are classified based on gray levels, that is, the numbers (addresses) of the one row of pixel points with the same gray level are put together in one group. Also, when the gray level data classifier classifies the addresses of the sub-pixel points which are displayed in the row of the display screen in correspondence with a the image gray level data of the sub-pixel points in the row, an address may be prescribed as 0 if there is no display for a certain image gray level data in a certain row. For example, when the same gray level 10H is displayed for the whole picture, a correspondence between the sub-pixel addresses and the gray level data for each row of the display is shown in Table 1.

TABLE 1

| gray level | sub-pixel address |
|---|---|
| GL = 0 | 0 |
| GL = 1 | 0 |
| . . . | . . . |
| GL = 16(10H) | 1, 2, 3, . . . , 3n − 1, 3n |
| . . . | . . . |
| GL = 64 | 0 |

A data and address encoding means is provided for encoding the addresses of the pixel points in the row having the same gray level. The encoding means, indicated by block 104 in FIG. 2, encodes the addresses of the pixel points in the row having the same gray level to form address codes corresponding to the same gray level. When performing mixed-encoding, if there is no display for a certain image gray level data in a certain row of sub-pixels, it may be prescribed that the data code of the encoded information code is a gray level data, and the address information is 0. For example, when the same gray level 10H is displayed for the whole display, a correspondence among the sub-pixel address, the gray level data, and the code for sub-pixel address in a row of the display is as shown in Table 2.

TABLE 2

| gray level | sub-pixel address | code for sub-pixel address |
|---|---|---|
| GL = 0 | 0 | 00 . . . 00(3n bit) |
| GL = 1 | 0 | 00 . . . 00(3n bit) |
| GL = 16(10H) | 1, 2, 3, . . . , 3n − 1, 3n | 11 . . . 11(3n bit) |
| . . . | . . . | |
| GL = 64 | 0 | 00 . . . 00(3n bit) |

It is important to encode the addresses of sub-pixel points. The less the bits are occupied after encoding, the greater the data compression ratio of a row will be, and the higher the efficiency of data bus transfer will be, and the lower the clock frequency required for transferring data will be. Thus, an optimal encoding method needs to be found. Then, the gray level data, and the addresses of all the sub-pixel points corresponding to the gray level, are mixed together to form the data information to be sent. Therefore, the data contains two parts, i.e., the address code and the gray data, wherein the first part is the address code or the gray level data code of the sub-pixel points, and the second part represents the gray level data code or address code of the sub-pixel, as shown in Table 3. It is also possible that the first part is the gray level data code or the address code of the sub-pixel, and the second part represents the address code or the gray level data code of the sub-pixel point, as shown in Table 4.

TABLE 3

| new codes of data | |
|---|---|
| first part | second part |
| sub-pixel address code | image gray level data |

TABLE 4

| new codes of data | |
|---|---|
| first part | second part |
| image gray level data | sub-pixel address code |

A differential signal sending means 105 sends the data processed in the control IC to the driving IC 106 in a differential signal. The purpose of using a differential signal is to reduce the electromagnetic interference. Examples of suitable differential signal sending means include mini-LVDS (mini-low voltage differential signal) or RSDS (reduced swing differential signal). The mini-LVDS signal sending means is described in further detail in the Texas Instruments Application Report SLDA007, issued in August 2001, and entitled *The mini-LVDS Interface Specification*, which is incorporated herein by reference. The RSDS interface means is described in further detail in the "Intra-panel Interface Specification", Rev. 1, which was issued by National Semiconductor in May 2003, and is also incorporated herein by reference. In additional to these differential signal sending methods, other means of sending differential signals, which would be known to those of ordinary skill in the art, may also be used for interfacing between the control IC 100 and the driving IC 106, without departing from the scope of the invention.

The above five functional blocks are mainly used to classify the original image gray level signal and perform compression using the sub-pixel addresses to form new information codes of the addresses plus image data. The object of such processing is to put the data with the same gray level together to be compressed, thereby improving the utilization ratio of the data transfer of the common bus, and reducing the frequency of transfer clock. The below functional blocks represent that the driving IC 106 performs decoding based on the received data, and sends the gray level data to corresponding output ports according to the addresses of the sub-pixel points.

The primary functions of the differential signal receiving means 107 are receiving the differential signal sent from the control IC 106, and converting the received signal to a transistor-transistor logic signal (TTL) that can be processed by the driving IC. The differential signal receiving means 107 can be a mini-LVDS interface receiver or a RSDS signal receiver, or other known type of differential signal interfacing means, as noted above. The data received by the differential signal receiving means 107 contains the image gray level data and addresses of all sub-pixel points corresponding to the gray level.

A data and address separating means, indicated by 108 in FIG. 2, receives the transistor-transistor logic signal (TTL) converted by the differential signal receiver 107, and separates the signal into the image gray level data and the address information of the sub-pixels in the panel corresponding to the image data.

The gray level data processor 109 processes the image gray level data separated by the data and address separating means 108.

The address decoding circuit 110 decodes the address information separated by the data and address separator 108. In particular, the address decoding circuit 110 decodes the address information of the sub-pixel points matched to each of the output ports of the driving IC. The specific operation is as follows: it is decided whether or not all the output ports of the driving IC correspond to the gray level data output according to the address information of the sub-pixel points, and if the output port corresponds to the gray level data output, the corresponding gray level data is written into a register corresponding to the output port; and if the output port of the driving IC does not correspond to the gray level data output, the driving IC discards the gray level data.

The channel addressing circuit 111 compares the address decoded by the address decoding circuit 110 to the address of the output port of the driving IC, and if one or more port addresses are consistent with the decoded address, sends the gray level data to the registers corresponding to the output ports until each gray level data in the whole row finds its corresponding output port.

The output circuit 112 converts data in the register corresponding to each port into a corresponding analog voltage through digital-analog (D/A) conversion, and outputs the analog voltage to the corresponding pixel points on the screen after amplification.

At last, it should be noted that the above embodiments are provided to describe the technical solutions of the present invention for illustration but not limitation. Although the present invention is described in detail with reference to the preferred embodiments, those skilled in this art may implement the present invention with various materials and devices as need, that is, may make modifications or equivalent substitution to technical solutions of the present invention without departing from the spirit or scope of the technical solutions of the present invention.

What is claimed is:

1. An intra-system interface unit in a flat panel display, comprising:

a control IC unit and a driving IC unit, the control IC unit receiving an image signal data output externally and compressing and processing the image signal data, and sending the image signal data to the driving IC unit through an interface therebetween, and the data being decompressed within the driving IC unit and then output, wherein the control IC unit comprises:

a signal receiver that receives the image signal data output externally, and decodes the image signal data to resolve the image signal data into a logic signal that can be processed within the control IC unit;

a gray level data classifier that receives the image signal data sent by the signal receiver, wherein each pixel point in the flat panel display includes a red sub-pixel point, a green sub-pixel point and a blue sub-pixel point, and the image signal data of a pixel point includes gray level data of the red sub-pixel point, gray level data of the green sub-pixel point, and gray level data of the blue sub-pixel point, the gray level data classifier further classifies respective sub-pixel points in a row on the flat panel display in accordance with gray level data of the respective sub-pixel points, and groups addresses of one or more of the sub-pixel points in the row that have a same gray level into one group;

a data and address encoder that receives data sent by the gray level data classifier, for the image signal data of each row, firstly address-encodes the respective sub-pixel points in the row such that each sub-pixel point has a unique address code, and then combines each gray level data in the row and address codes corresponding to the sub-pixel points having the gray level data together for being mixed-encoded to form an information code to be sent, the information code containing the gray level data and corresponding sub-pixel address code; and a differential signal sender that receives the information code sent from the data and address encoder, converts the information code to a differential signal according to a certain rule, and sends the information code through the interface to the driving IC unit, where the information code is decompressed and then output.

2. The intra-system interface unit of claim 1, wherein when the gray level data classifier classifies the addresses of the sub-pixel points which are displayed in the row on the flat panel display based on the gray level data of the sub-pixel points in the row, an address is prescribed as 0 when there is no display for a certain gray level data in the sub-pixels points of a certain row.

3. The intra-system interface unit of claim 1, wherein when the data and address encoder performs mixed-encoding, if there is no display for a certain gray level data in the sub-pixel points of a certain row, then the image signal data of the encoded information code is a gray level data, and the corresponding sub-pixel address code is 0.

4. The intra-system interface unit of claim 1, wherein the driving IC unit comprises:

the differential signal receiver that receives a differential signal sent from the control IC unit, decodes the differential signal, and converts the decoded differential signal into a transistor-transistor logic signal that can be processed by the driving IC unit, the received differential signal containing the gray level data and the corresponding sub-pixel address code;

a data and address separator that receives the transistor-transistor logic signal sent from the differential signal receiver, and separates the transistor-transistor logic signal into the gray level data and the addresses for the sub-pixels in the row of the flat panel display corresponding to the gray level data;

a gray level data processor that receives the gray level data separated by the data and address separator and processes the gray level data;

an address decoder that receives and decodes the addresses separated by the data and address separator, the address decoder decides if the driving IC has the address of the sub-pixel output corresponding to the decoded addresses, and writes the corresponding gray level data into a register corresponding to an output port if the result of the decision is confirmative; and if the output port corresponding to the driving IC does not have an address corresponding to the gray level data, the driving IC discards the gray level data;

a channel addressing circuit that receives signals sent from the gray level data processor and the address decoding circuit, compares the address decoded by the address decoding circuit to the port address output from the driving IC, and sends the gray level data to the register corresponding to the output port until each gray level in the whole row finds a corresponding output port, if one or more port addresses are consistent with the decoded address; and an output circuit that receives signals sent from the channel addressing circuit, converts the gray level data in the register corresponding to each port into a corresponding analog voltage through digital-analog conversion, and outputs the analog voltage to the corresponding sub-pixel points in the row of the panel after amplification.

* * * * *